United States Patent [19]

Vole

[11] Patent Number: 4,845,689

[45] Date of Patent: Jul. 4, 1989

[54] CLOCK

[76] Inventor: Michael Vole, 23857 N. Hwy. 21, Mundelein, Ill. 60060

[21] Appl. No.: 177,190

[22] Filed: Apr. 4, 1988

[51] Int. Cl.[4] ..... G04C 19/00; G04B 19/24

[52] U.S. Cl. ..... 368/82; 368/29; 368/223; 368/276

[58] Field of Search ..... 368/10, 28, 29, 79, 368/80, 82, 88, 223, 276, 277, 278, 316, 317

[56] References Cited

U.S. PATENT DOCUMENTS

| | | | |
|---|---|---|---|
| 3,574,992 | 4/1971 | Ladas | 368/82 |
| 3,691,755 | 9/1972 | Girard | 368/29 |
| 3,854,279 | 12/1974 | Edmunds | 368/82 |
| 4,483,626 | 11/1984 | Noble | 368/10 |
| 4,540,292 | 9/1985 | Rubenstein et al. | 368/29 |

*Primary Examiner*—Vit W. Miska

*Attorney, Agent, or Firm*—Paul H. Gallagher

[57] ABSTRACT

A clock in the form of a traffic light, with time designations shown in the red, amber and green lenses. The time designations include the day of the week, hour of the day, and month and date.

1 Claim, 1 Drawing Sheet

CLOCK

FIELD OF THE INVENTION

The invention resides in the field of clocks having special features beyond the mere indication of time, including for example decorative features, indications of day and date, and have similarity to other objects.

OBJECTS OF THE INVENTION

A broad object of the invention is to provide a clock having unusual and attractive features.

Another object is to provide such a clock having a novel construction similar to a traffic control light, including lights of different colors and indications of various phases of time showing in the lights.

DESCRIPTION OF A PREFERRED EMBODIMENT

Figure 1:
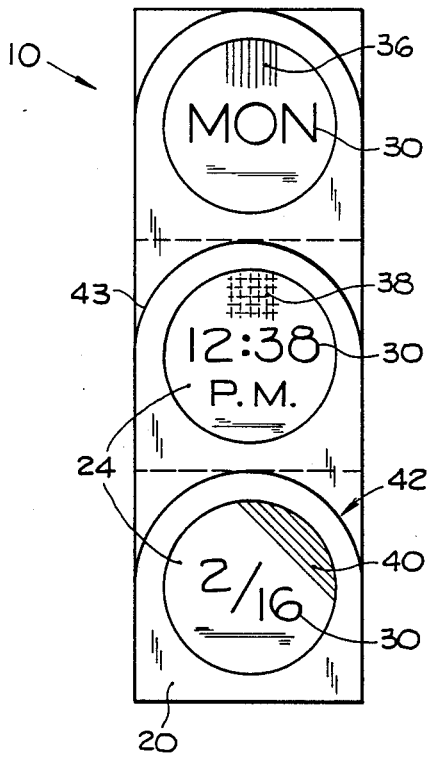
FIG. 1 is a front view of the device of the invention.
Figure 2:
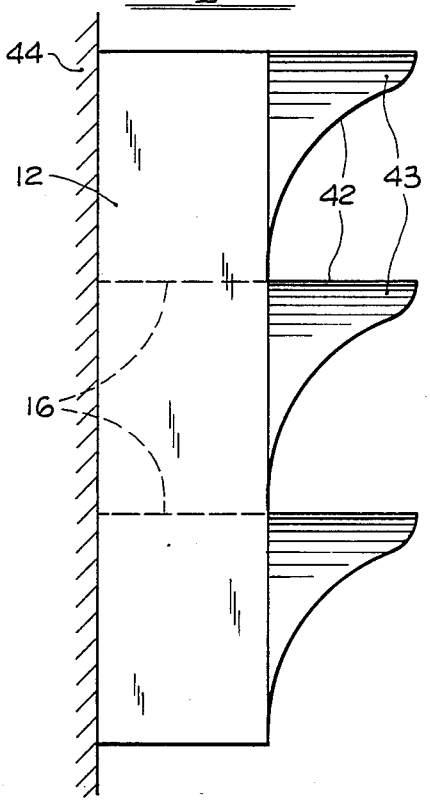
FIG. 2 is a side view.
Figure 3:
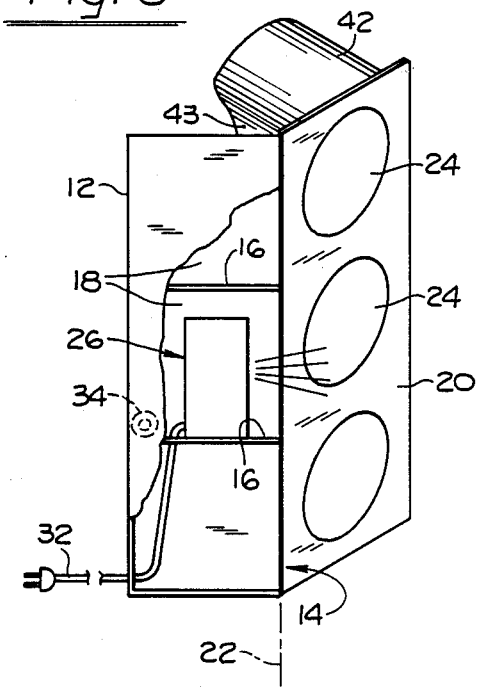
FIG. 3 is a side view with the door open and a portion of the near side wall broken away.

Referring in detail to the device of the invention, the device as a whole in indicated at 10 and is of the overall appearance of a traffic control light. The device includes a box 12 having front open side 14 and vertically spaced partitions 16 forming three cells or cubicles 18 positioned relatively vertically therein. The box and partitions are of opaque material and the cells thus light-insulated from each other. The box in the present case includes a door 20, hinged at 22 to swing between closed and open positions. In closed position, the interior of the box is closed. The interior may be made accessible by a removable part, other than the door.

The device includes three lenses 24, in this case mounted in the door, and when the door is in closed position, the lenses are in register with the cells 16. The lenses 24 are transparent, and are utilized in the production of time indications as referred to hereinbelow.

Mounted in each of the cells 16 is a clock unit 26, of known kind. The clock units are capable of producing time indications on the respective lenses according to their own characteristics, the projection thereof being indicated by the lines 28. These clock units are of the digital type, and the indications, indicated at 30 are produced by contrast in the indications produced on the lenses. As noted above, the lenses are transparent, for example of plastic or glass, and the indications are of light projections being transmitted through the lenses. The time indications are made by contrast between the time indications and the remainder of the lenses, such as having the shape of the indications clear, i.e. without color, and the remaining part of the lens colored. Such signal indications of light are produced in a known manner by the clock unit 24, and need not be entered into in detail herein. The overall body of the lens, i.e. that portion other than the time indications, produces an overall colored effect of the lens. The lenses therefore, with this overall colored effect, are of the corresponding colors in a traffic light signal, namely, proceeding downwardly, red, amber, and green respectively.

The clock units, including the light means therein, such as bulbs, are of electrical nature, and energized in a convenient way, such as by a light cord 32, but preferably a standby battery 34 may be provided also.

Figure 4:
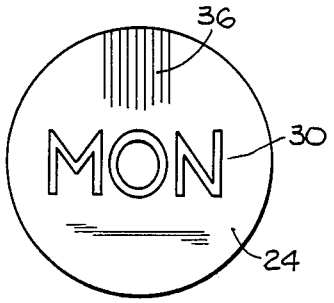
FIG. 4 is a detail showing a lens and a visual time indication thereon.

FIG. 4 shows a lens 24 with the time indication 30 thereon. The representation of the signal 30 in FIG. 4 represents clear spaces within the confines of the letters of the indication, and the remaining part of the lens is colored as indicated at 36, in this case red. Attention is directed also to FIG. 1 showing the colors red, amber, green, in corresponding shading, at 36, 38, 40.

The door 20 is provided with shields 42, positioned above the lenses, simulating a similar construction in the case of traffic lights. The shields are preferably shell shape, with their concave side down, and including side elements 43 that decrease circumferentially in forward direction, these shields extending forwardly from the door, and thus from the lenses.

These shields 42, in addition to simulating a traffic light construction, provide a shielding effect on the lenses, to render the lenses more easily observed, and the time indications more easily read.

A principal feature of the invention is the provision of the different time indications on the respective lenses. While the particular indications may be as desired, the present arrangement includes the day of the week in the top, red lens, the hour of the day in the middle, amber lens, and the day of the month in the bottom, green lens. These time indications being of different character, are of considerable convenience, in providing the information of the three different phases of the time. The clock may be of substantial size, such as for example as 24″ tall and 8″ wide, and it may be utilized in any of various locations, such as the home or the office, and it may be mounted on the wall as indicated at 44, or set on a desk. While time pieces heretofore have been made to show different phases of time, there have not been any showing the present arrangement in which the different phases are shown on different lenses, i.e. at different locations, with the added advantage of each being shown in a lens of different color, and still further, these advantageous features being incorporated in a relative large time piece, or clock, that may be observed easily at a distance. The shields 42 not only present a simulation of a traffic light, but they shield the lenses so as to produce a very pronounced contrast between the time indications and the general color background of the lens, but prevent excess light coming from the exterior to fall on the lens. Additionally the clock may be positioned adjacent a window, and the light from the window, and this extra light, which is very often of great intensity, is shielded and prevented from obscuring the deliberate time indications produced in the lens.

Another great advantage is the attractiveness and unusual effect of the clock, which is in striking contrast to an ordinary clock, whether polygonal, circular, etc.

I claim:

1. A clock comprising, a frame having a plurality of cells therein having front sides presented to a single point of view, receptive elements positioned at the front sides of the cells, capable of receiving visual indications of time and presenting them to said point of view, clock units in the respective cells operable for projecting such visual indications on the receptive elements representing different phases of time on the respectively different receptive elements, the cells being light-insulating from each other and from the exterior except at the front sides, the receptive elements being consituted by transparent lenses, the clock units being operable for producing such visual indications of light character and the lenses being capable of transmitting them through themselves, the clock simulates a traffic control light in appearance, but includes special construction and produces special results as set out hereinbelow, the frame includes a box of opaque material having dividers forming the cells, also of opaque material, the box having a front side in which the front sides of the cells lie, being closed except at the front side, the cells and lenses are three in number and the box has an upright position wherein the cells and lenses are arranged in a vertical tier, the clock units and lenses together being operable for producing such visual indications of digital character wherein, in each lens, a light contrast is produced between the indication and the remainder of the lens, and an overall color effect of the lens is produced, the individual indications being of the day of the week, the hour of the day, and the date, irrespective of the vertical position of the lenses, the individual overall color effects proceeding downwardly being red, amber, and green, and the box including shields at the front side and extending forwardly therefrom, over the respective cells, each shield being generally in the form of a sheel having its concave side directed downwardly and including side elements decreasing in circumferential direction proceeding forwardly.

* * * * *